US009821488B2

(12) United States Patent
Yang et al.

(10) Patent No.: US 9,821,488 B2
(45) Date of Patent: Nov. 21, 2017

(54) SEPARATING DEVICE

(71) Applicant: MiiCs & Partners (Shenzhen) Co., Ltd., Shenzhen (CN)

(72) Inventors: Ming-Lu Yang, New Taipei (TW); Ya-Dong Zhang, Zhejiang (CN); Jing-Ping Zheng, Zhejiang (CN)

(73) Assignee: MiiCs & Partners (Shenzhen) Co., Ltd., Shenzhen (CN)

( * ) Notice: Subject to any disclaimer, the term of this patent is extended or adjusted under 35 U.S.C. 154(b) by 261 days.

(21) Appl. No.: 14/509,266

(22) Filed: Oct. 8, 2014

(65) Prior Publication Data

US 2015/0102083 A1 Apr. 16, 2015

(30) Foreign Application Priority Data

Oct. 12, 2013 (CN) ..... 2013 2 0628796 U

(51) Int. Cl.
*B26F 3/04* (2006.01)
*B07C 5/06* (2006.01)

(52) U.S. Cl.
CPC ..... *B26F 3/04* (2013.01); *B07C 5/06* (2013.01); *Y10T 225/371* (2015.04)

(58) Field of Classification Search
CPC ..... B26F 3/00; B26F 3/04; B07C 5/06; Y10T 225/321; Y10T 225/325
USPC ..... 225/96, 96.5, 103
See application file for complete search history.

(56) References Cited

U.S. PATENT DOCUMENTS 3,465,634 A * 9/1969 Blais ..... B26D 7/1818 225/96
4,767,482 A * 8/1988 Diez ..... B29C 65/18 156/163
5,599,269 A * 2/1997 Oetlinger ..... B26D 7/02 225/103
5,979,730 A * 11/1999 Yuta ..... B28D 5/0058 225/102
6,460,258 B1 * 10/2002 Shimotoyodome .... B28D 1/225 225/96
6,536,121 B1 * 3/2003 Ishikawa ..... C03B 33/10 225/96
6,578,748 B2 * 6/2003 Matsuoka ..... B23D 31/003 225/100
7,494,034 B2 * 2/2009 Wisniewski ..... B23D 31/003 225/100

(Continued)

FOREIGN PATENT DOCUMENTS

JP 2004042233 A * 2/2004

*Primary Examiner* — Jason Daniel Prone
*Assistant Examiner* — Richard Crosby, Jr.
(74) *Attorney, Agent, or Firm* — ScienBiziP, P.C.

(57) ABSTRACT

A separating device for separating a continuous single piece of material into individual work pieces includes an supporting block, a moving assembly, a separating assembly and an controller. The supporting block defines a feeding portion for the single material to pass through. The moving assembly is connected to the feeding portion and blows into the feeding portion to push individual work pieces to move along the feeding portion. The separating assembly is positioned on the supporting block. The controller is positioned on either side of the supporting block for recording and signaling the creation of an individual work piece. When the controller signals another work piece, the first separating element presses a following work piece.

1 Claim, 5 Drawing Sheets

(56) References Cited

U.S. PATENT DOCUMENTS

| | | | | |
|---|---|---|---|---|
| 7,559,446 | B2 * | 7/2009 | Duchesne | B28D 5/0011 225/2 |
| 2002/0023939 | A1 * | 2/2002 | Hase | B23D 31/003 225/2 |
| 2006/0175371 | A1 * | 8/2006 | Cavallo | B23D 31/003 225/96 |
| 2008/0061100 | A1 * | 3/2008 | Hansch | B23D 31/003 225/96 |

* cited by examiner

SEPARATING DEVICE

FIELD

The subject matter herein generally relates to a separating device in manufacturing process.

BACKGROUND

In industrial application, to improve production efficiency or reduce labor cost, it is necessary for solid materials to be separated into a plurality of pieces, for example, according to different sizes, geometries, or qualities of the solid materials, for a further treatment of the pieces.

BRIEF DESCRIPTION OF THE DRAWINGS

Implementations of the present technology will now be described, by way of example only, with reference to the attached figures.

DETAILED DESCRIPTION

Figure 1:
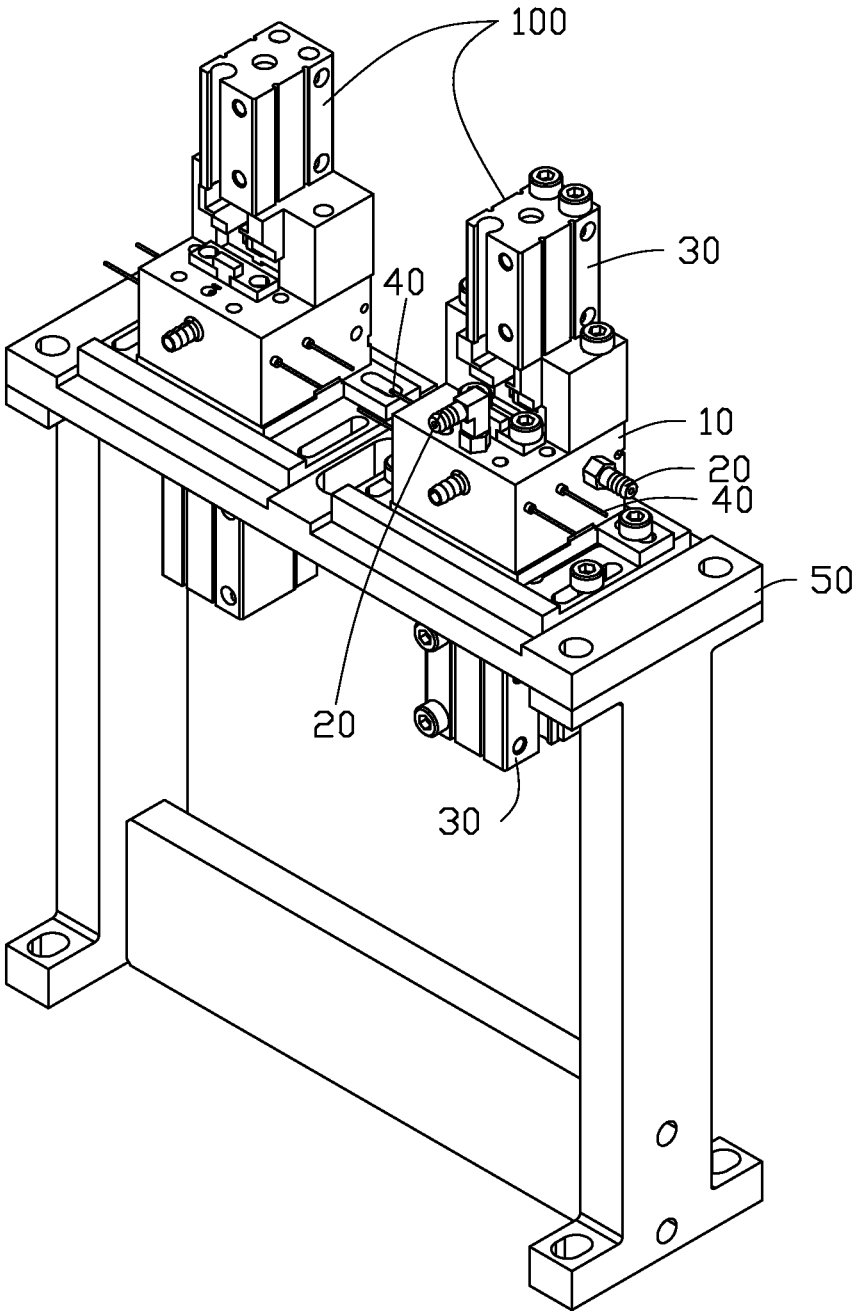
FIG. 1 is an isometric view of a separating device installed on a work table.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising", when utilized, means "including, but not necessarily limited to"; it specifically indicates open-ended inclusion or membership in the so-described combination, group, series, and the like.

The present disclosure is described in relation to a separating device.

Figure 4:
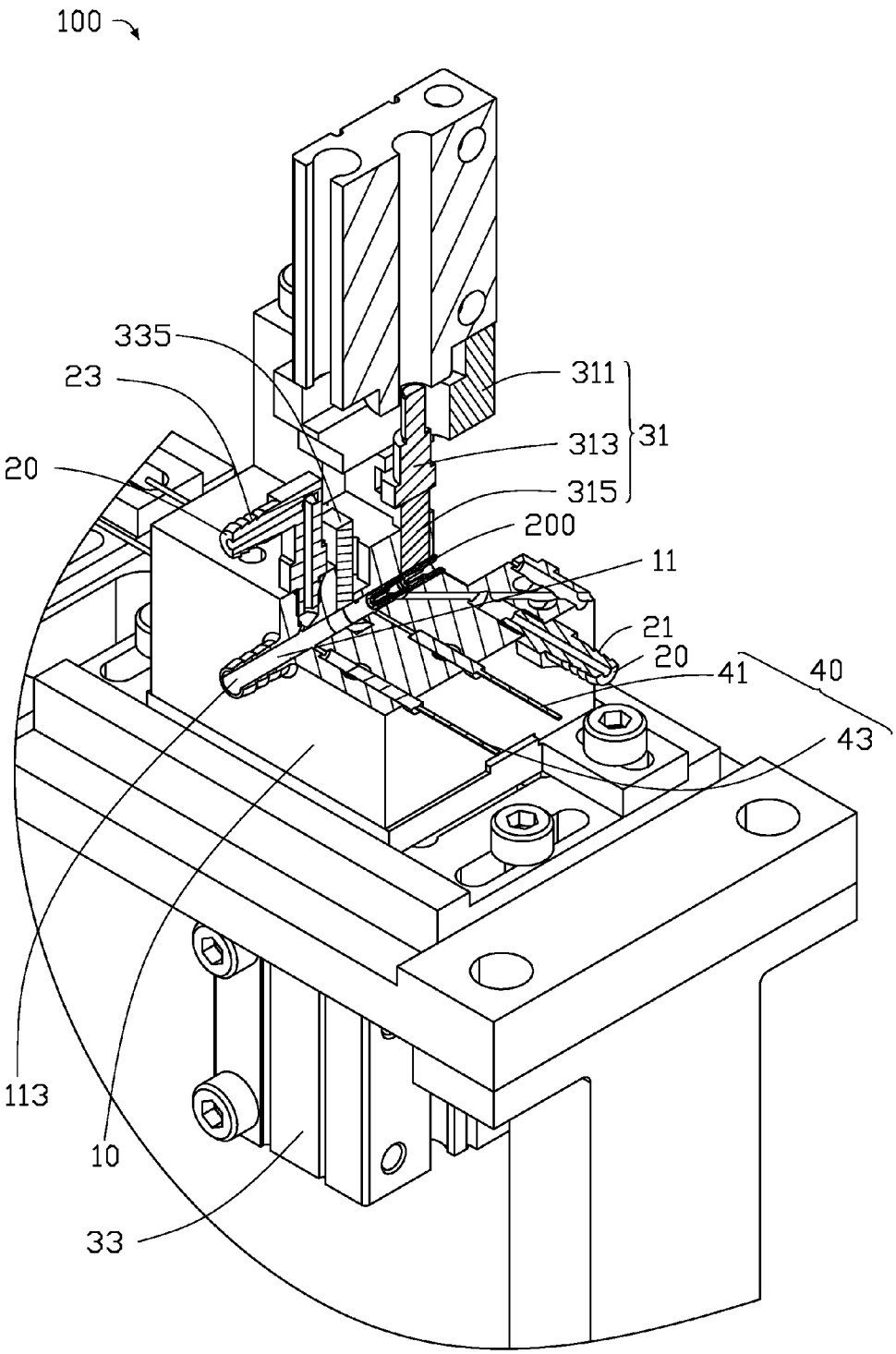
FIG. 4 is a cross-sectional, isometric view of the separating device shown in FIG. 1 in a working state.

FIG. 1 illustrates that a separating device 100 can include a supporting block 10, a moving assembly 20, a separating assembly 30, and a controller 40. The separating device 100 can be used for separating a single item of material into individual pieces. The single item of material can be a feed component, such as a component of plastic plugs 200 (as shown in FIG. 4). In at least one embodiment, two separating devices 100 can be installed on a work table 50 to work together and be positioned parallel with each other. Each separating device 100 can be installed on the work table 50 by the supporting block 10. The moving assembly 20 can be fixed on the supporting block 10 to communicate with the supporting block 10. The separating assembly 30 of each separating device 100 can be vertically installed on the supporting block 10. The controller 40 can be horizontally installed on the sides of the supporting block 10.

Figure 2:
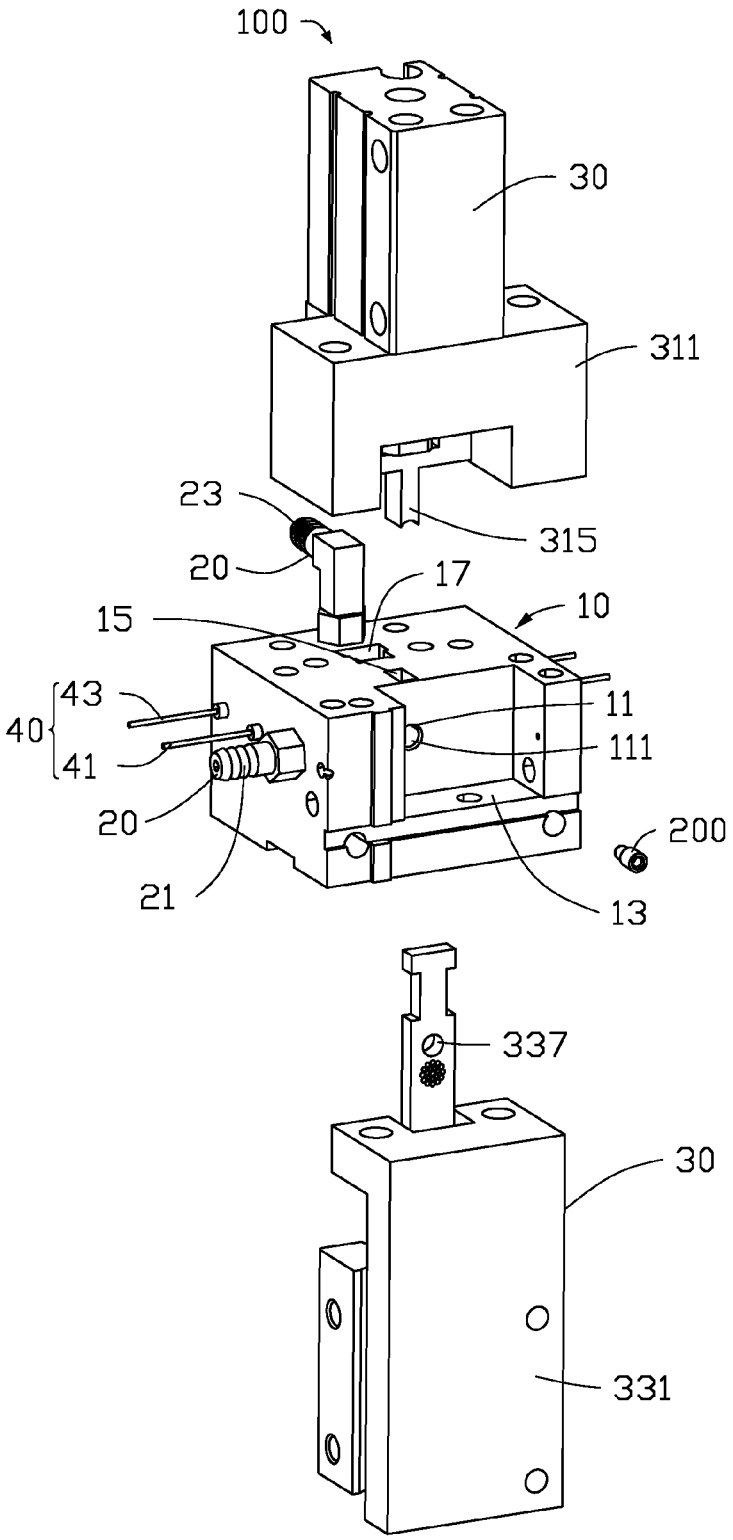
FIG. 2 is an exploded, isometric view of the separating device shown in FIG. 1.
Figure 3:
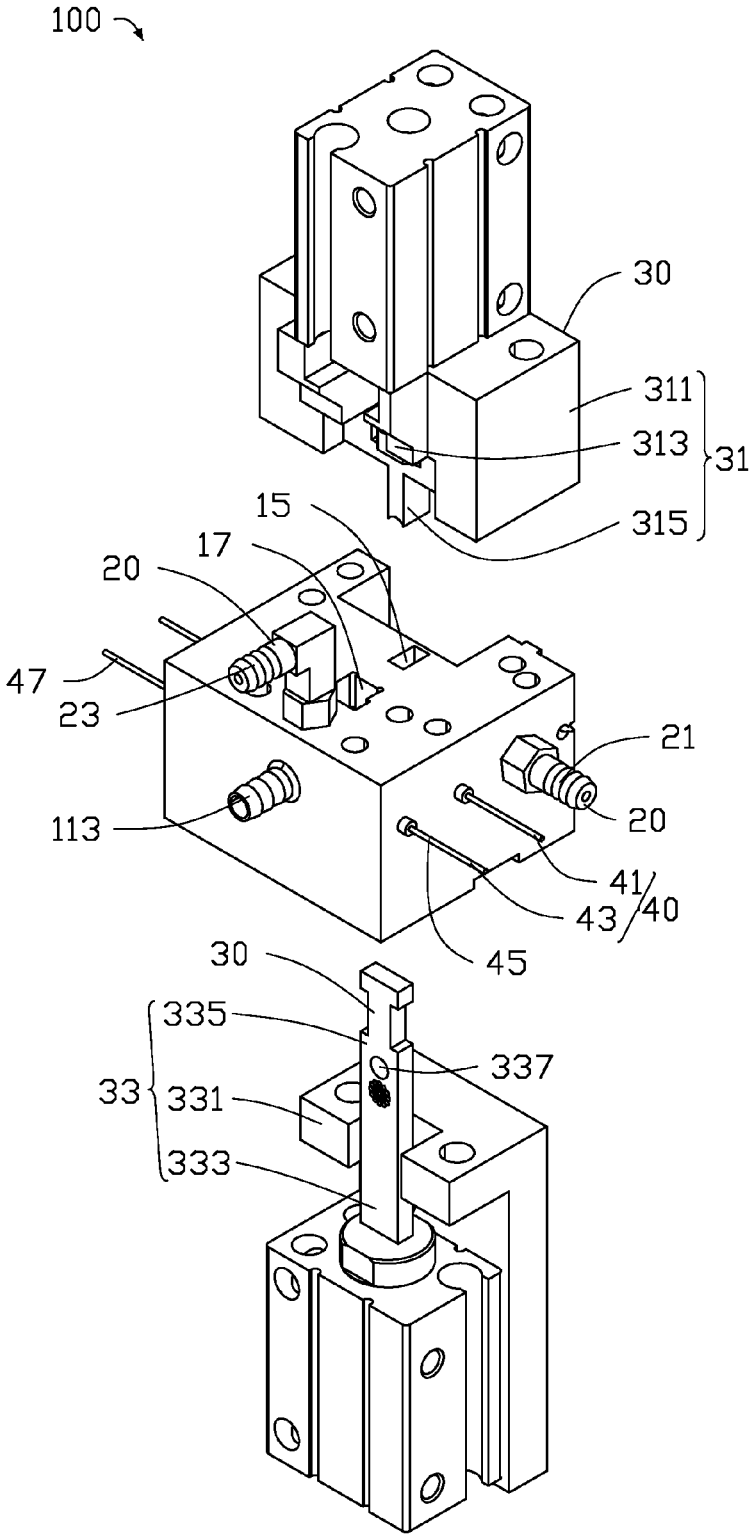
FIG. 3 is an exploded, isometric view of the separating device shown in FIG. 2 from another angle.

FIGS. 2-3 illustrate that the supporting block 10 can be substantially square and have a feeding portion 11. The feeding portion 11 can be defined inside and can be passing through the supporting block 10. The feeding portion 11 can have a feeding port 111 and a discharge port 113 extending outside the supporting block 10. The feeding port 111 and discharge port 113 can be positioned facing each other, and can respectively function as an entrance and an exit of the feeding portion 11. In at least one embodiment, the separating device 100 can be used for creating separate work pieces, for example, a plurality of plastic plugs 200. The plastic plug 200 can be substantially cylindrical. The feeding port 111 can be connected to an exterior conveyer belt used for conveying the single piece of material. The discharge port 113 can be used for outputting the separated plastic plugs 200.

The supporting block 10 can define a rectangular groove 13 adjacent to the feeding port 111, for connecting to the conveyer belt. The supporting block 10 can define an installing hole 15, and a fixing hole 17 adjacent to the installing hole 15. The installing hole 15 and the fixing hole 17 can be connected to the feeding portion 11 for installing the separating assembly 30. An axis of the installing hole 15 and fixing hole 17 can be substantially perpendicular to the supporting block 10, and the installing hole 15 and fixing hole 17 can horizontally pass through the supporting block 10.

The moving assembly 20 can be connected to the feeding portion 11 and an exterior blowing device to blow into the feeding portion 11. By creating a high air pressure in the feeding portion 11 via the moving assembly 20, the plastic plug 200 can be pushed to move along the feeding portion 11, that is, the plastic plug 200 is moved through the feeding portion 11 of the supporting block 10 by the moving assembly 20. The moving assembly 20 can include a first blowing pipe 21 and a second blowing pipe 23. The first blowing pipe 21 can be substantially horizontally positioned on a side of the supporting block 10 adjacent to the controller 40, and near to the feeding port 111. The plastic plug 200 in the feeding portion 11 can be pushed to move toward the discharge port 113 when the first blowing pipe 21 blows air. The second blowing pipe 23 can be positioned on the side facing the separating assembly 30 and near to the discharge port 113. An end of the second blowing pipe 23 extending away from the supporting block 10 can be substantially parallel with the discharge port 113. By blowing into the feeding portion 11 via the second blowing pipe 23, the plastic plug 200 can be pushed to move out of the feeding portion 11 from the discharge port 113.

The separating assembly 30 can include a first separating element 31 and a second separating element 33 which is substantially a mirror image of the first element 31. The first separating element 31 and second separating element 33 can be positioned on opposite sides of the supporting block 10. The first separating element 31 can include a fixing block 311, a first rod 313, and a pressing block 315.

The fixing block 311 can be fixed on the supporting block 10 adjacent to the second blowing pipe 23. The first separating element 31 can be thus fixed on the supporting block 10 by the fixing block 311. The first rod 313 can be accommodated in the fixing block 311 and be capable of moving with the first separating element 31. The first rod 313 can be elastic, thereby having a variable length relative to the supporting block 10.

The pressing block 315 can be positioned on an end of the first rod 313 extending to the supporting block 10. The pressing block 315 can be capable of moving with the first rod 313. The pressing block 315 can be accommodated in the installing hole 15 facing the feeding portion 11. The pressing block 315 can vertically move in the installing hole 15 with the first rod 313, to press the plastic plug 200 in the feeding portion 11 or move away from the plastic plug 200. When the pressing block 315 presses the plastic plug 200, the plastic plug 200 can become immobile in the feeding portion 11. When the pressing block 315 moves away from the plastic plug 200, the plastic plug 200 can move along the feeding portion 11, thereby passing across the pressing block 315. A shape and size of an end of the pressing block 315 facing the plastic plug 200 can be suited to the plastic plug 200, to avoid pressure-related damage.

The second separating element 33 can include a connecting block 331, a second rod 333, and a protecting plate 335. The connecting block 331 can be fixed on a side of the supporting block 10 away from the first separating element 31. The second separating element 33 can be fixed on the supporting block 10 by the connecting block 331. The second rod 333 can be accommodated in the connecting block 331 and capable of moving with the second separating element 33. The protecting plate 335 can be positioned at an end of the second rod 333 near to the supporting block 10 and be capable of moving with the second rod 333. The second rod 333 can be elastic thereby having a variable length relative to the supporting block 10.

The protecting plate 335 can further define a circular through hole 337 in the supporting block 10, and the through hole 337 can be configured for the plastic plug 200 to pass through. The shape and size of the through hole 337 can be suited to the plastic plug 200. The protecting plate 335 can be accommodated in the fixing hole 17 facing the feeding portion 11. The protecting plate 335 can move along the fixing hole 17 with the second rod 333, whereby the through hole 337 moves to face the feeding portion 11 or moves away from the plastic plug 200. When the through hole 337 faces the feeding hole 11, the plastic plug 200 can pass through the protecting plate 335 via the through hole 337. When the through hole 337 moves away from the feeding portion 11, the plastic plug 200 is obstructed by the protecting plate 335.

The controller 40 can be used for recording the creation of a plastic plug 200 and generating a signal once having recorded the creation of the plastic plug 200. In at least one embodiment, the controller 40 can be electrically connected to an exterior control unit, to transmit the signal to the exterior control unit. The exterior control unit can be further connected to the separating assembly 30, thereby controlling the separating assembly 30 to horizontally move. The exterior control unit can process the signal taken from the controller 40, and control the first separating element 31 or the second separating element 33 to horizontally move.

The controller 40 can include a first sensor 41 and a second sensor 43 parallel with the first sensor 41. The first sensor 41 and second sensor 43 can substantially perpendicularly extend away from the supporting block 10. The first sensor 41 can be horizontally positioned on the supporting block 10 and adjacent to the first blowing pipe 21. The second sensor 43 and the first sensor 41 can be parallel with and distanced from each other. The second sensor 43 can be located between the first sensor 41 and the first blowing pipe 21.

Each first sensor 41 and each second sensor 43 can include an emitting unit 45 and a receiving unit 47. The emitting unit 45 and the receiving unit 47 can be defined as the two ends of each first sensor 41 and of each second sensor 43. Each emitting unit 45 and receiving unit 47 can be symmetrically located on either side of the supporting block 10 and extend in two opposite directions.

Figure 5:
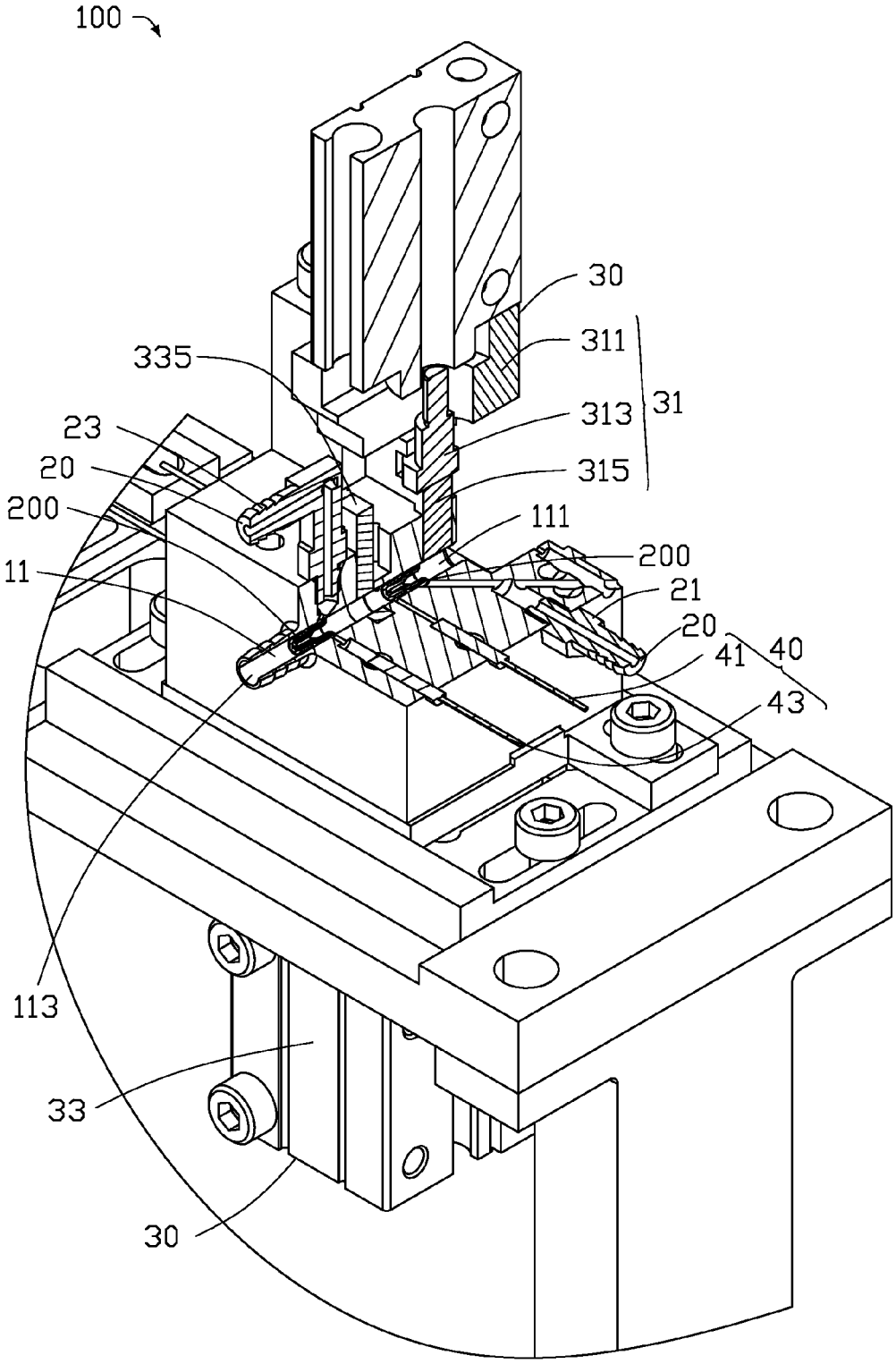
FIG. 5 is a cross-sectional, isometric view of the separating device shown in FIG. 4 in another working state.

FIGS. 4-5 illustrate that the first sensor 41 can be located between the pressing block 315 and the protecting plate 335, and a distance between the first sensor 41 and the pressing block 315 can be substantially same as a length of the plastic plug 200. In other embodiments, the distance between the first sensor 41 and protecting plate 335 can be substantially more than the length of the plastic plug 200. The second sensor 43 can be located between the discharge port 113 and the protecting plate 335, and the distance between the second sensor 43 and protecting plate 335 can be substantially same as the length of the plastic plug 200. In other embodiments, the distance between the second sensor 43 and protecting plate 335 can be substantially more than the length of the plastic plug 200.

When the receiving unit 47 is receiving a light beam from the emitting unit 45 (as shown in FIG. 3), the plastic plug 200 has not arrived between the emitting unit 45 and the receiving unit 47. In this situation, the first sensor 41 and the second sensor 43 are idle. When the light beam from the emitting unit 45 is received by the unit 47, the plastic plug 200 can have arrived between the emitting unit 45 and the receiving unit 47 (as shown in FIG. 5). At the same time, the first sensor 41 or the second sensor 43 can record the plastic plug 200.

When the first sensor 41 can record and signal the creation of a plastic plug 200 but the second sensor 43 is idle, the signal can be transmitted to the exterior control unit to control the first separating element 31 to move so that the pressing block 315 can press the plastic plug 200. The exterior control unit can control the second separating element 33 to move, and the through hole 337 (as shown in FIG. 3) can be moved to face the feeding portion 11.

When the second sensor 43 can record and signal the creation of a plastic plug 200 but the first sensor 41 is idle, the signal can be transmitted to the exterior control unit to control the second separating element 33 to move so that the through hole 337 can move away from the feeding portion 11. The protecting plate 335 can thus obstruct the plastic plug 200 (as shown in FIG. 3). The exterior control unit can then control the first separating element 31 to move away from the plastic plug 200 (as shown in FIG. 3).

In assembly, the first separating element 31 and the second separating element 33 can be positioned on opposite sides of the supporting block 10. At the same time, the pressing block 315 can be accommodated in the installing hole 15, and the protecting plate 335 can be accommodated in the fixing hole 17 (as shown in FIG. 3). Then, the controller 40 can be installed on the supporting block 10 and connected to the exterior control unit. The first sensor 41 can be positioned between the pressing block 315 and the protecting plate 335, and the second sensor 43 can be positioned between the discharge port 113 and the protecting plate 335. The first separating element 31 and the second separating element 33 can be connected to the exterior control unit. Finally, the first blowing pipe 21 and the second blowing pipe 23 can be installed on the supporting block 10 and connected to the feeding portion 11. Assembly of the separating device 100 can thus be completed.

In operation, a single material can enter the feeding portion 11 from the exterior conveyer belt connected to the feeding port 111. During a prior working state, the pressing block 315 cannot press any first plastic plug 200 and the protecting plate 335 can obstruct the feeding portion 11. At the same time, the first plastic plug 200 can be pushed to pass across the pressing block 315, by reason of the moving assembly 20 blowing into the feeding portion 11.

When the first plastic plug 200 activates the first sensor 41, the first sensor 41 can generate a signal. Simultaneously, the second sensor 43 cannot generate any signal. The signal can be transmitted to the exterior control unit and the exterior control unit can control the pressing block 315 to press the single material entering the feeding portion 11 behind the first plastic plug 200. At the same time, the exterior control unit can further control the protecting plate 335 to move so that the through hole 337 can move to face the feeding portion 11. The first blowing pipe 21 can blow into the feeding portion 11, whereby the first plastic plug 200 can move to the second sensor 43 through the through hole 337 (as shown in FIG. 3) toward the discharge port 113.

The second sensor 43 can thus record and signal a first plastic plug 200 but the first sensor 41 is idle. The signal can be transmitted to the exterior control unit and the exterior unit can control the through hole 337 to move away from the feeding portion 11, whereby the protecting plate 335 (as shown in FIG. 3) can obstruct the feeding portion 11. The exterior control unit can further control the pressing block 315 to move away from the second plastic plug 200. The second blowing pipe 23 can blow into the feeding portion 11 to push the first plastic plug 200 to move away from the second sensor 43 and exit from the discharge port 113. The second plastic plug 200 which is following can repeat substantially the same motion as the first plastic plug 200. The plurality of plastic plugs 200 can thus be separated and move out via the discharge port 113.

As the separating device 100 can have a feeding portion 11 through the supporting block 10 for the plastic plug 200 to move therein, a moving assembly 20 to blow into the feeding portion 11, a separating assembly 30; and an controller 40 to record and signal the creation of a plastic plug 200, the plurality of plastic plugs 200 can be obtained. The separating device 100 can automatically separate the plastic plugs 200.

The embodiments shown and described above are only examples. Many details are often found in the art such as the other features of a separating device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A separating device for separating a feed component into a plurality of work pieces, comprising:

a supporting block with a feeding portion;

a moving assembly positioned on the supporting block;

a separating assembly positioned on the supporting block, the separating assembly having a first separating element; and a control module;

wherein, the feed component is moved through the feeding portion of the supporting block by the moving assembly; and wherein, when activated by the control module, the first separating element is pressed into the feed component separating one of the plurality of work pieces from the feed component, wherein the supporting block further includes an installing hole connected to the feeding portion, and a fixing hole connected to the feeding portion, wherein the separating assembly further includes a second separating element including a connecting block positioned on a side of the supporting block away from the first separating element; a second rod positioned in the connecting block and accommodated in the installing hole; and a protecting plate.

* * * * *